United States Patent [19]

Smallwood

[11] Patent Number: 4,561,794

[45] Date of Patent: Dec. 31, 1985

[54] FOLDER FOR PAPERS

[76] Inventor: John W. Smallwood, 10 Middle Rock Rd., Lake Cathie, New South Wales, 2446, Australia

[21] Appl. No.: 475,544

[22] Filed: Mar. 15, 1983

[51] Int. Cl.[4] ..... B42F 13/00; B42F 3/00

[52] U.S. Cl. ..... 402/75; 402/500

[58] Field of Search ..... 402/75, 79, 15, 21, 402/78, 14, 19, 20, 21, 24; 24/67 R; 29/13

[56] References Cited

U.S. PATENT DOCUMENTS

| | | | |
|---|---|---|---|
| 717,957 | 1/1903 | Weaver | 402/79 |
| 910,194 | 1/1909 | Harris | 402/14 |
| 1,665,128 | 4/1928 | Cather | 402/14 |
| 1,832,239 | 11/1931 | Pedersen | 402/79 |
| 2,005,717 | 6/1935 | Coulton | 402/14 |
| 2,601,125 | 6/1952 | O'Connor | 402/79 |
| 2,634,730 | 4/1953 | Hoffman | 402/79 |
| 2,725,881 | 12/1955 | Goldman | 402/78 |
| 2,799,275 | 7/1957 | Darden | 402/79 |
| 3,107,673 | 10/1963 | Haddad | 402/79 |
| 3,275,003 | 9/1966 | Chamberlin | 402/79 |

FOREIGN PATENT DOCUMENTS

| | | | |
|---|---|---|---|
| 643124 | 9/1950 | United Kingdom | 402/500 |

*Primary Examiner*—Paul A. Bell

*Attorney, Agent, or Firm*—Ladas & Parry

[57] ABSTRACT

An attachment for a folder to enable the removable attachment to the folder of correspondence by a pin with the correspondence being removable with the pin so as to be retained in a bound form when removed from the folder.

6 Claims, 5 Drawing Figures

FOLDER FOR PAPERS

The present invention relates to folders and more particularly but not exclusively to reusable folders from which material contained in the file may be removed thereby enabling further use of the file.

It is a particular disadvantage of known filing systems which employ a folder such as a manilla folder, that the folders are generally not reused. However, some folders are manufactured from plastics material, but in order for the folder to be reused, the material contained therein must be removed, which removal is generally difficult and does not retain the removed contents in their correct sequence.

It is an object of the present invention to overcome or substantially ameliorate the above disadvantages.

There is disclosed herein an attachment for a folder enabling the removable fixing of correspondence to the folder via a pin having a generally planar head with a pair of plastically deformable elongated legs extending from one major surface of the head, the legs having a greater width than depth and confronting major surfaces, said attachment comprising a piece of sheet material to be fixed to the folder so that a major surface of the piece confronts a major surface of the folder, a slot extending inwardly from the edge of the piece, said slot having a width greater than the combined depth of the legs adjacent the head, but narrower than the greatest width of the legs adjacent said head, an opening in said piece at the inner extremity of the slot, said opening being dimensioned so that in the plane of said piece said head would be prevented from movement through the opening, and wherein said head is locatable between the confronting surfaces of the file and attachment with said legs extending through said opening by movement of the legs along said slot, said head being captively locatable between the confronting surface of the file and attachment by said legs extending through said opening with the width of the legs generally transverse of said slot.

A preferred form of the present invention will now be described by way of example with reference to the accompanying drawings, wherein.

Figure 1:
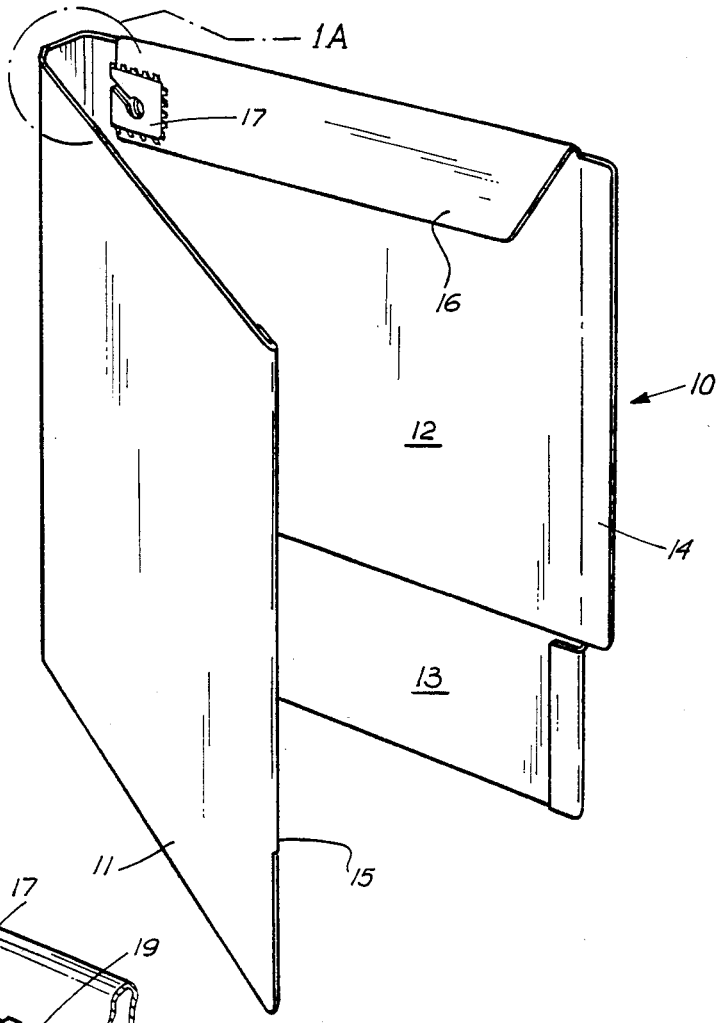
FIG. 1 is a schematic perspective view of a folder adapted to releasably retain documents.
Figure 1A:
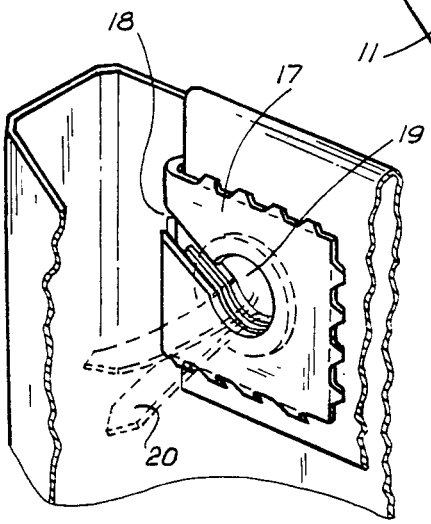
FIG. 1A is a schematic perspective view of the portion A of FIG. 1.
Figure 2:
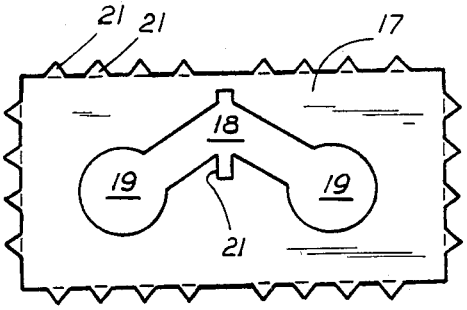

FIG. 2 schematically depicts in elevation a reinforcing member to be used with the folder of FIG. 1.

Figure 3:
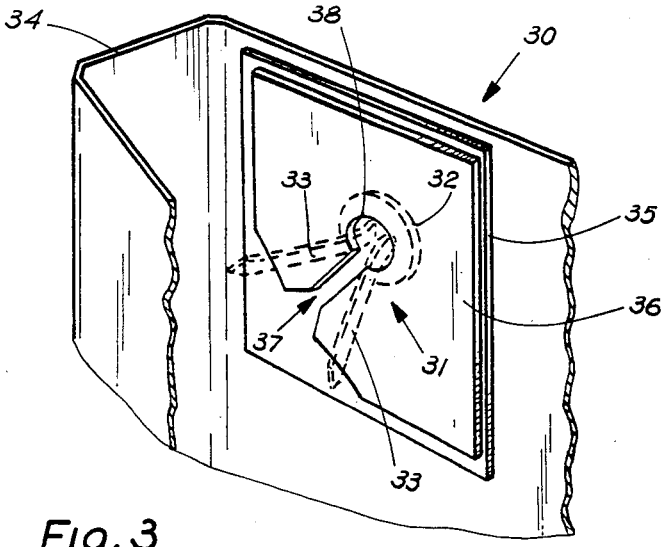
Figure 4:
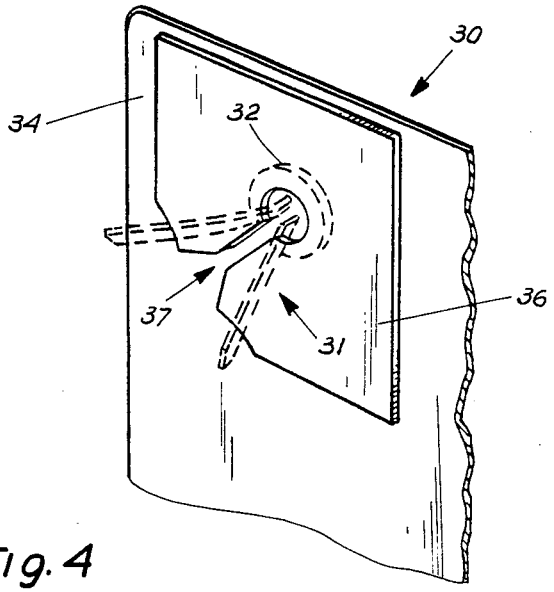

FIGS. 3 and 4 are schematic perspective views of folders each with an attachment to releasably secure documents to the folders.

In FIG. 1 there is schematically depicted a folder 10 which has two flaps 11 and 12. The flap 12 is adapted to receive the documents and retain the documents within the folder 10. The flap 12 is also provided with a pocket flap 13 and an identification strip 14 which projects generally beyond the side 15 of the flap 11. Additionally the flap 12 is provided with an upper document receiving strip 16 which receives a reinforcing member 17 which may be made of plastics, metal or another material which would substantially reinforce the material of the strip 16. The strip 16 and reinforcing member 17 cooperate to define a slot 18 which terminates in an enlarged portion 19 which receives a pin 20 to which documents are fixed. Additionally the slot 18 would have an elongated portion 21 to enable removal of the head of the pin.

Preferably the reinforcing member 17 is manufactured of metal and is bent to a substantially U-shaped configuration to thereby clampingly engage the strip 16. Additionally the reinforcing member 17 would have spiked projections 21 which securely engage the strip 16. Alternatively, other materials may be employed, such as plastics or cardboard, which other materials may be adhesed to the strip 16 to thereby provide a reinforcing area around the slot 18.

In operation of the above folder 10, the pin 20 is adapted to receive documents to thereby retain the documents within the folder. However, the documents may be removed from within the folder while retaining them in their correct sequence by rotation of the pin 20 so that it is aligned with the slot 18 thereby enabling its removal.

The above folder 10 may be made of plastics material, cardboard or any other suitable material.

Referring now to FIGS. 3 and 4 wherein there is schematically depicted an attachment 30 to releasably secure the pin or clip 31 having a slot 32 and elongated legs to a folder 34. The attachment 30 in the embodiment of FIG. 3 has a backing sheet 35 fixed to a front sheet 36 so as to provide a hollow for the entry of the slot 32 so that the slot 32 is located between the confronting surface of the backing 35 and front sheet 36. The front sheet 36 has a slot 37 to enable the legs 33 to pass through so that the slot 32 may be located behind the hole 38. When the legs 33 extend through the hole 38 the pin or clip 31 is turned so that the width of the legs 33 extends generally transverse of the slot 37 to thereby captively locate the slot 32 between the backing 35 of the front sheet 36. Preferably the front sheet 36 and backing 35 would be formed of plastics material with the backing 35 provided with an adhesive for fixing to the folder 34.

In FIG. 4 the attachment 30 is depicted having a front sheet 36, however the backing 35 has been removed so that it is now necessary for the front sheet 36 to be directly attached to the folder 34.

It would also be preferred that the portion of the front sheet 36 adjacent the entrance of the slot 37 be bowed outward to thereby facilitate the entry of the slot 32 between the front sheet 36 and backing 35 of folder 34.

What I claim is:

1. In combination: a pin; a folder, and an attachment for the folder enabling removeable fixing of one or more sheets to the folder via said pin; said pin having a generally planar head with a pair of plastically deformable elongated legs extending from one major surface of the head, said legs being generally thin so as to have a greater transverse width than thickness; said attachment comprising a piece of sheet material superimposed on the folder and fixed thereto, said attachment and said folder co-operating to generally enclose a space large enough to receive said head, said space having an open end allowing said head to be located in said space, said open end being at least partially defined by an edge of said piece, a slot extending inwardly from said edge; said slot having a transverse width greater than the combined thickness of the legs adjacent the major surface of said head, but narrower than the transverse width of the legs adjacent said head; an opening in said piece at the inner extremity of the slot, said opening being dimensioned so that in the direction perpendicular to the plane of said piece said head would be prevented from movement through the opening, and wherein said slot allows said head to be located in said space by movement of the legs along said slot; whereby upon being located in said space, said head is captively held by said piece by positioning said legs so as to extend through said opening but then generally transverse of said slot.

2. The combination of claim 1, wherein said attachment includes a backing sheet attached to said piece so that the head of said pin is captively located between said piece and said backing sheet.

3. The combination of claim 2, wherein said backing sheet is provided with adhesive for fixing to the folder.

4. The combination of claim 1, wherein said attachment is provided with a serrated edge defining deformable projections which are adapted to be plasticallydeformed after piercing the folder to fix the attachment to the folder.

5. The combination of claim 1, wherein said attachment is formed of a sheet of strip metal bent back upon itself so as to define two of said slots and two of said openings, so that in use said attachment is bent back upon itself to clampingly engage the folder.

6. The combination of claim 1 wherein said slots intersect, and said attachment is further provided with an elongated opening at the intersection of said slots to enable the head of said pin to pass through said elongated opening.

* * * * *